US011448001B2

(12) United States Patent
Ueda

(10) Patent No.: US 11,448,001 B2
(45) Date of Patent: Sep. 20, 2022

(54) LOCKING DEVICE AND DOOR DRIVING UNIT INCLUDING THE SAME

(71) Applicant: NABTESCO CORPORATION, Tokyo (JP)

(72) Inventor: Shinji Ueda, Kobe (JP)

(73) Assignee: NABTESCO CORPORATION, Tokyo (JP)

( * ) Notice: Subject to any disclaimer, the term of this patent is extended or adjusted under 35 U.S.C. 154(b) by 305 days.

(21) Appl. No.: 16/550,537

(22) Filed: Aug. 26, 2019

(65) Prior Publication Data

US 2020/0087972 A1 Mar. 19, 2020

(30) Foreign Application Priority Data

Sep. 18, 2018 (JP) ..... JP2018-173503

(51) Int. Cl.
*E05F 11/34* (2006.01)
*E05F 15/655* (2015.01)
*E05F 15/652* (2015.01)

(52) U.S. Cl.
CPC ..... *E05F 15/655* (2015.01); *E05F 15/652* (2015.01); *E05Y 2201/43* (2013.01); *E05Y 2201/638* (2013.01); *E05Y 2900/51* (2013.01)

(58) Field of Classification Search
CPC ..... E05F 15/652; E05F 15/635; E05F 15/632; E05F 15/655; E05Y 2201/22; E05Y 2201/718; E05Y 2201/43; E05Y 2201/604; E05Y 2201/706; E05Y 2201/214; E05Y 2201/42; E05Y 2201/412; E05Y 2201/708; E05Y 2201/638; E05Y 2201/64; E05Y 2900/51; E05Y 2600/32; E05Y 2600/133; E05Y 2800/404
USPC ..... 49/362, 324, 322, 116, 118, 104, 90.1, 49/503, 370, 93; 292/341.17, 153, 292/DIG. 46
See application file for complete search history.

(56) References Cited

U.S. PATENT DOCUMENTS 4,745,705 A * 5/1988 Yamamoto ..... A01N 25/18 43/125
5,077,938 A 1/1992 Moreuil
5,341,598 A * 8/1994 Reddy ..... E05F 15/40 49/362

(Continued)

FOREIGN PATENT DOCUMENTS

CN 107339045 A 11/2017
EP 1721802 A1 11/2006

(Continued)

OTHER PUBLICATIONS

Extended European Search Report dated Feb. 6, 2020 issued in corresponding EP Application No. EP 19192238.4.

(Continued)

*Primary Examiner* — Chi Q Nguyen
(74) *Attorney, Agent, or Firm* — Pillsbury Winthrop Shaw Pittman, LLP

(57) ABSTRACT

A locking device includes a cam that is formed in a rotating unit configured to rotate about a rotational center axis that is parallel to an opening width direction of a door, and the cam permits or prohibits movement of a door leaf in the opening width direction in accordance with a rotational position of the rotating unit.

6 Claims, 14 Drawing Sheets

(56) References Cited

U.S. PATENT DOCUMENTS 5,755,060 A * 5/1998 Zweili ..... E05B 65/0829 49/322
6,009,668 A * 1/2000 Reddy ..... E05C 3/34 49/280
6,032,416 A * 3/2000 Springer ..... B60J 5/062 49/119
6,094,867 A * 8/2000 Reddy ..... E05D 15/0652 49/280
6,282,970 B1 * 9/2001 Oakley ..... E05F 15/652 74/89.14
6,446,389 B1 * 9/2002 Heffner ..... B61D 19/02 49/280
6,712,406 B2 * 3/2004 Stojc ..... B60J 5/062 292/144
7,228,804 B2 * 6/2007 Stojc ..... E05B 77/00 105/286
8,661,732 B2 * 3/2014 Kong ..... E05B 83/363 49/118
2012/0011778 A1 * 1/2012 Kong ..... E05B 81/00 49/503
2012/0073208 A1 * 3/2012 Lee ..... E05F 15/652 49/449

FOREIGN PATENT DOCUMENTS

| | | | |
|---|---|---|---|
| EP | 2436860 | A2 | 4/2012 |
| JP | 4-228788 | A | 8/1992 |
| JP | 10-18712 | A | 1/1998 |
| JP | 3060832 | U | 6/1999 |
| TW | 200710313 | A | 3/2007 |

OTHER PUBLICATIONS

Notice of Reasons for Refusal dated May 31, 2022 issued in corresponding Japanese Patent Application No. 2018-173503, with English translation (6 pgs.).

* cited by examiner

LOCKING DEVICE AND DOOR DRIVING UNIT INCLUDING THE SAME

CROSS-REFERENCE TO RELATED APPLICATIONS

This application is based on and claims the benefit of priority from Japanese Patent Application Serial No. 2018-173503 (filed on Sep. 18, 2018), the contents of which are hereby incorporated by reference in their entirety.

TECHNICAL FIELD

The present invention relates to a locking device for locking a door leaf and a door driving unit including the locking device.

BACKGROUND

A door driving unit is disclosed in Japanese Laid-Open Patent Publication No. 4-228788 ("the '788 Publication"). The door driving unit disclosed in the '788 Publication includes a reversible screw and a carriage that reciprocates along the reversible screw. The carriage includes a nut that slides on the reversible screw. When the reversible screw rotates, the carriage moves along the reversible screw. Movement of the carriage causes a door to move. The door driving unit includes a locking device for fixing the door.

SUMMARY

A locking device requires a reversible screw and a nut that moves in accordance with rotation of the reversible screw. One object of the present invention is to provide a locking device and a door driving unit capable of locking a door leaf irrespective of whether a reversible screw and a nut are provided.

(1) A locking device addressing the above object comprises a cam formed in a rotating unit configured to rotate about a rotational center axis that is parallel to an opening width direction of a door, the cam being configured to permit or prohibit movement of a door leaf in the opening width direction in accordance with a rotational position of the rotating unit. With this arrangement, the door leaf can be locked easily.

(2) In the locking device, the cam has a cam surface configured to contact with a contact portion that moves together with the door leaf, and the cam surface is configured to advance in a direction in which the contact portion enters, while turning about the rotational center axis. With this arrangement, the rotating unit including the cam can be rotated when the contact portion that moves together with the door leaf contacts with the cam surface.

(3) The locking device further comprises a rotation prohibiting portion for prohibiting rotation of the rotating unit at such a position as to prohibit the movement of the door leaf when the door leaf has reached a door closing position. With this arrangement, the door leaf can be prohibited from moving.

(4) A door driving unit addressing the above object comprises: the locking device; and a door driving device for driving the door leaf in the opening width direction when the cam is in such a position as to permit the movement of the door leaf in the opening width direction. With this arrangement, when the cam is in a position where the door leaf is permitted to move in the opening width direction, the door leaf can be driven in the opening width direction.

(5) In the door driving unit, the door driving device includes: a base member extending in the opening width direction of the door; and a rotary moving unit in contact with the base member, the rotary moving unit being configured to rotate and move along the base member, thereby to move the door leaf in the opening width direction. With this arrangement, the moving unit for moving the door leaf can have a small size.

(6) In the door driving unit, the base member is capable of moving in an opening direction of the door leaf by a drive force of a motor when the door leaf has reached a door closing position, and the base member moving in the opening direction of the door leaf contacts with a rotation prohibiting portion for prohibiting rotation of the rotating unit, thereby to prohibit the rotating unit from rotating. With this arrangement, when the door leaf is positioned in the door closing position, the rotation of the rotating unit can be prohibited by the movement of the base member. Therefore, the rotation of the rotating unit can be prohibited with a simple structure.

(7) In the door driving unit, the rotation prohibiting portion, formed as a second cam, is positioned in an opposite side of the rotating unit to the cam, formed as a first cam, with respect to the rotational center axis. With this arrangement, the rotating unit having the rotational center axis can be formed in a short dimension.

DESCRIPTION OF THE EMBODIMENTS

Figure 1:
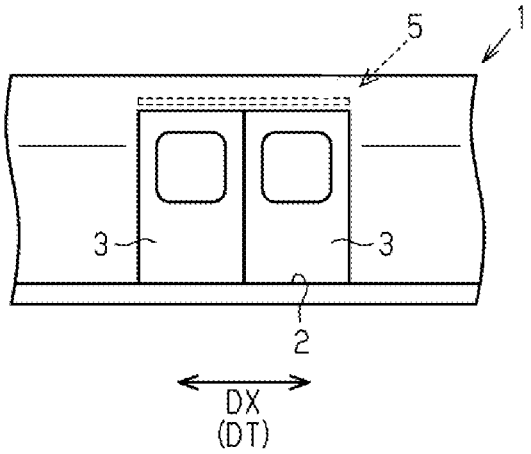
FIG. 1 is a front view of a vehicle.

The door driving unit will now be described with reference to FIGS. 1 to 20.

A railroad vehicle 1 includes a door. The door includes a door leaf 3 for opening and closing a door opening 2. A door driving unit 5 is mounted to the vehicle 1 to neighbor the door opening 2. The door driving unit 5 includes a door driving device 10 and a locking device 80. The door driving device 10 moves the door leaf 3, and the locking device 80 locks the door leaf 3.

The door leaf 3 is opened and closed by operation of the door driving device 10. The door leaf 3 moves along the front-rear direction of the vehicle 1. The door driving device 10 is mounted to the vehicle 1 to neighbor the door opening 2. The door leaf 3 is mounted to a moving unit 30 (described later) of the door driving device 10. The door leaf 3 is moved (opened and closed) in accordance with movement of the moving unit 30. The locking device 80 prohibits the moving unit 30 from moving when the door leaf 3 is in a door closing position. Thus, the door leaf 3 can be fixed at the door closing position.

For example, the door driving device 10 is installed in a wall above the door opening 2. The door leaf 3 is hung from a guide rail with a hanger (not shown) and is guided in the front-rear direction by the guide rail extending in the front-rear direction of the vehicle 1. The door leaf 3 moves on the power of the door driving device 10.

Figure 2:
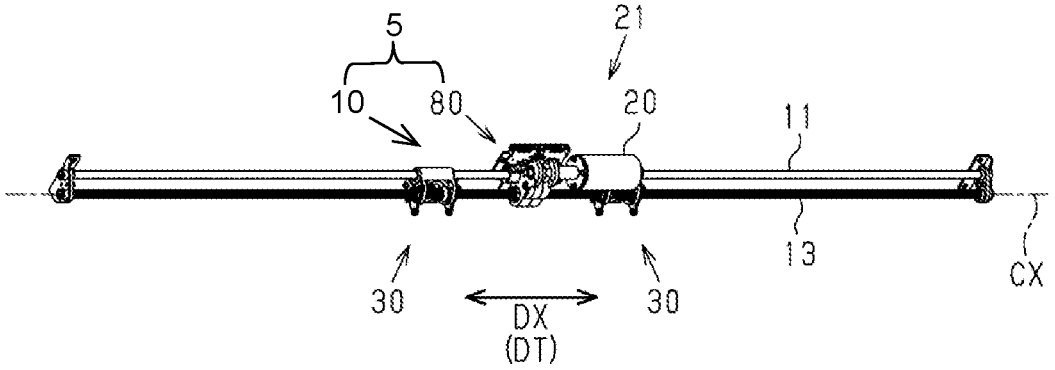
FIG. 2 is a perspective view of a door driving device.
Figure 3:
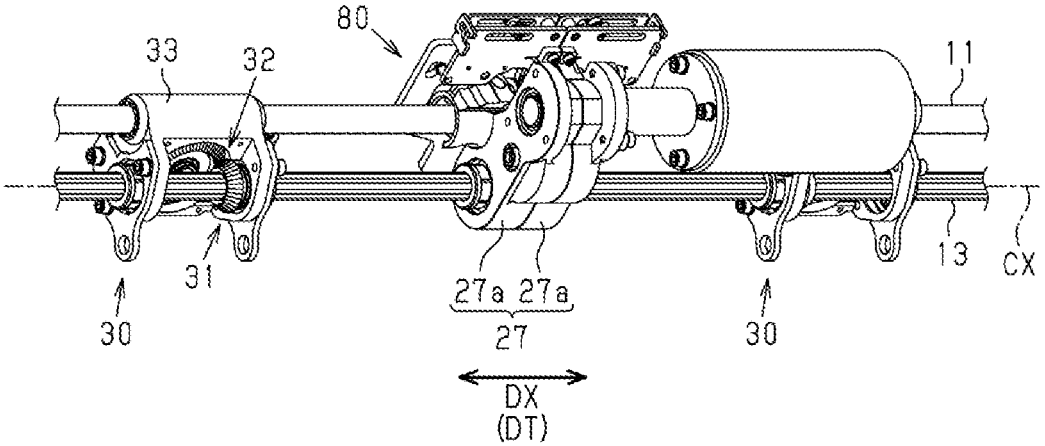
FIG. 3 is a partial perspective view of the door driving device.

As shown in FIGS. 2 and 3, the door driving device 10 includes a base member 11, a rotary shaft 13 that rotates by the power of a motor 21, a rotary moving unit 32, and a transmission member 31. The rotary moving unit 32 is preferably a component of the moving unit 30 that moves the door leaf 3.

The base member 11 extends in the opening width direction DT of the door leaf 3. In other words, the base member 11 is installed such that the extension direction DX thereof corresponds to the opening width direction DT of the door leaf 3. The base member 11 includes teeth 12 (see FIG. 9) arranged in the extension direction DX thereof. The teeth 12 of the base member 11 mesh with the rotary moving unit 32 described above. More specifically, the base member 11 is formed as a rack in a rack-and-pinion structure.

The rotary shaft 13 extends along the extension direction DX of the base member 11. The rotary shaft 13 is arranged in parallel to the base member 11 and rotates about the rotational center axis CX of the rotary shaft 13. The rotational center axis CX extends along the extension direction DX of the base member 11. The rotary shaft 13 rotates by the power of a drive device 20 (described later). The rotary shaft 13 has a circumferential surface 14 extending along the circumference centered at the rotational center axis CX. The circumferential surface 14 (see FIG. 7) has at least one groove 15 formed therein and extending in parallel to the rotational center axis CX.

Figure 4:
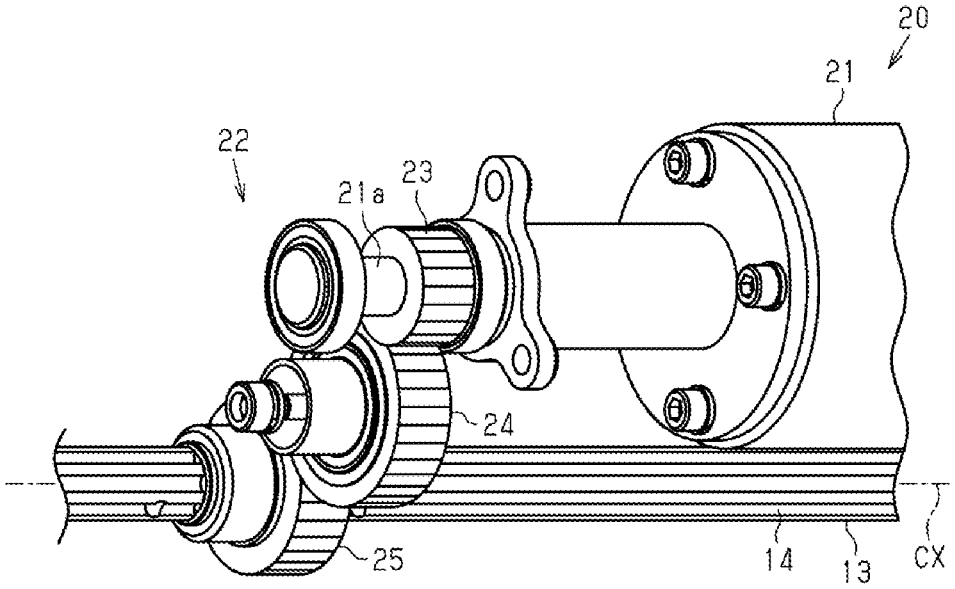
FIG. 4 is a perspective view of a speed reducer.
Figure 5:
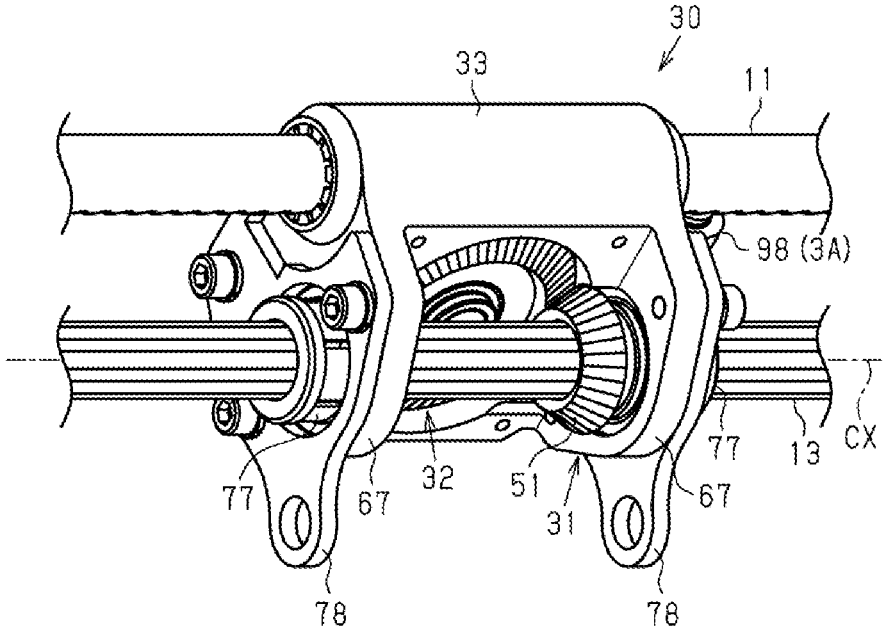
FIG. 5 is a perspective view of a moving unit.

As shown in FIG. 4, the drive device 20 includes the motor 21 and a speed reducer 22. The speed reducer 22 includes an output gear 23, a first reduction gear 24, and a second reduction gear 25. The output gear 23 is mounted to an output shaft 21*a* of the motor 21, the first reduction gear 24 meshes with the output gear 23, and the second reduction gear 25 meshes with the first reduction gear 24. The output gear 23, the first reduction gear 24, and the second reduction gear 25 are rotatably housed in a casing 27 constituted by a pair of cases 27*a* (see FIG. 11). The output gear 23 rotates integrally with the output shaft 21*a* of the motor 21. The first reduction gear 24 rotates on rotation of the output gear 23. The second reduction gear 25 rotates on rotation of the first reduction gear 24. The second reduction gear 25 rotates integrally with the rotary shaft 13. The rotational power of the motor 21 is transmitted to the rotary shaft 13 via the output gear 23, the first reduction gear 24, and the second reduction gear 25. Thus, the rotary shaft 13 rotates by the power of the motor 21.

The moving unit 30 and the transmission member 31 will now be described with reference to FIGS. 5 to 9.

The moving unit 30 moves on the rotational power of the rotary shaft 13. The rotational power of the rotary shaft 13 is transmitted to the moving unit 30 via the transmission member 31.

The transmission member 31 can move relatively to the rotary shaft 13 in the axial direction thereof. The transmission member 31 also rotates along with the rotary shaft 13 and contacts with the rotary moving unit 32 of the moving unit 30, thereby to transmit the rotational power of the rotary shaft 13 to the rotary moving unit 32 of the moving unit 30. Further, when transmitting the rotational power of the rotary shaft 13 to the rotary moving unit 32 of the moving unit 30, the transmission member 31 receives a force from the moving unit 30 and moves along with the moving unit 30.

More specifically, the transmission member 31 includes a sliding member 41 and a first bevel gear 51 (a first gear). The sliding member 41 rotates integrally with the rotary shaft 13 and slides in the axial direction with respect to the rotary shaft 13, and the first bevel gear 51 is coupled with the sliding member 41. The first bevel gear 51 meshes with a second bevel gear 56 (a second gear) fixed to the rotary moving unit 32 of the moving unit 30. Thus, the transmission member 31 transmits the rotational power to the rotary moving unit 32 of the moving unit 30 via the first bevel gear 51.

Figure 6:
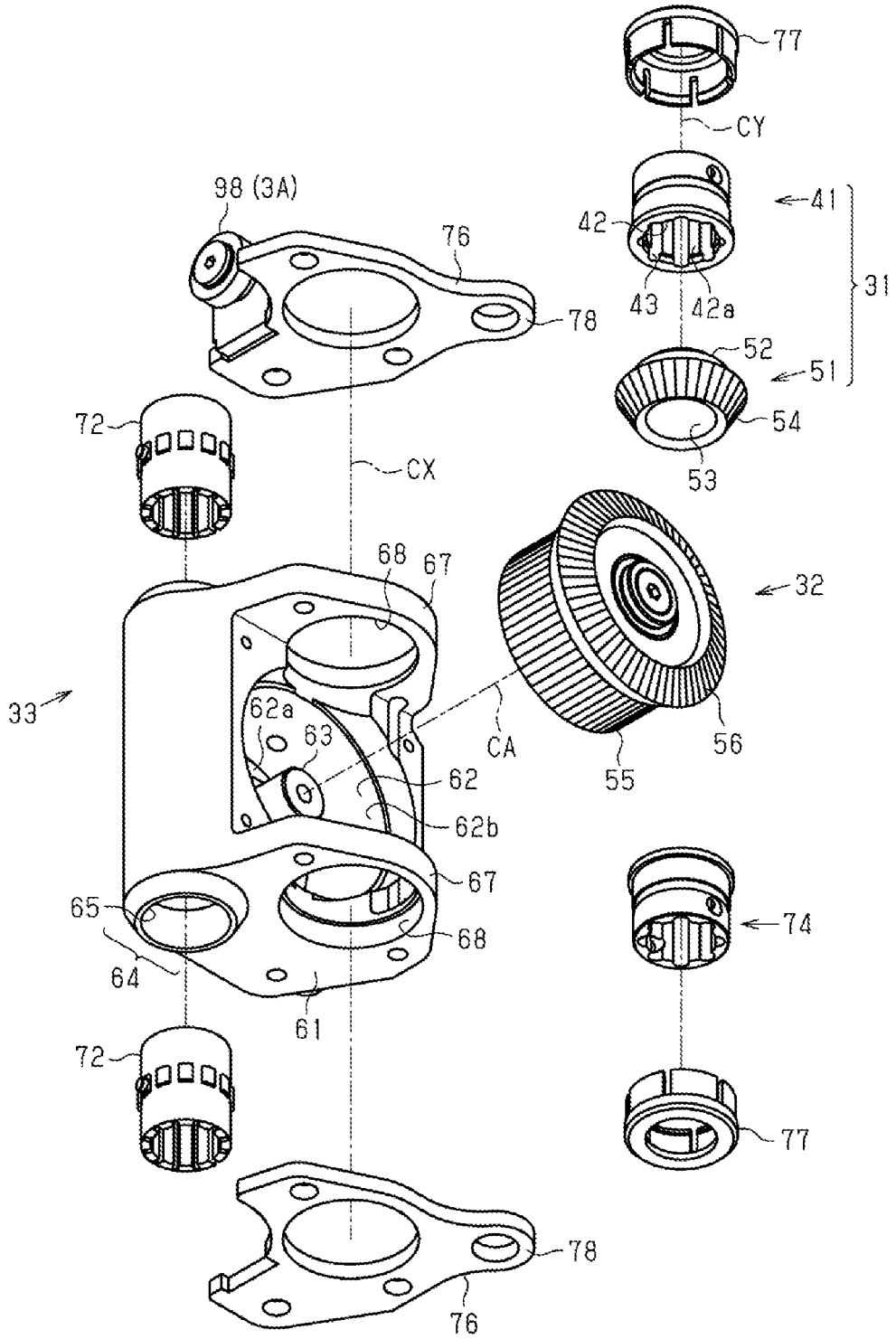
FIG. 6 is an exploded perspective view of the moving unit.
Figure 7:
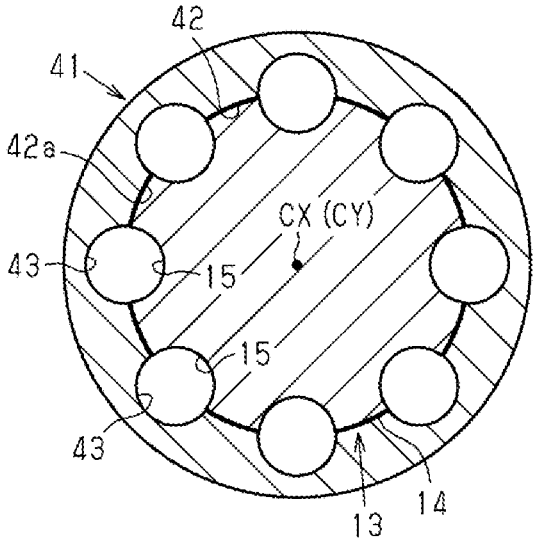
FIG. 7 is a sectional view of a rotary shaft and a sliding member.

As shown in FIGS. 6 and 7, the sliding member 41 has an insertion hole 42 penetrated by the rotary shaft 13. After the sliding member 41 is mounted, the center axis CY of the insertion hole 42 corresponds to the rotational center axis CX of the rotary shaft 13 (see FIG. 7). The inner circumferential surface 42*a* of the insertion hole 42 extends along a circumference centered at the center axis CY. In the inner circumferential surface 42*a*, there is provided at least one groove 43 extending along the center axis CY. The width of the groove 43 is equal to the width of the groove 15 in the rotary shaft 13. The groove 43 in the sliding member 41 and the groove 15 in the rotary shaft 13 constitute a cylindrical space. This space houses a cylindrical rod or a spherical ball. With this structure, the sliding member 41 is restricted from rotating in the circumferential direction about the center axis CY with respect to the rotary shaft 13 and is allowed to move along the rotary shaft 13. Also, the sliding member 41 is retained by a retainer 33 via a ring-shaped bearing 45 (see FIG. 10). Thus, the sliding member 41 rotates about the center axis CY with respect to the retainer 33.

The first bevel gear 51 includes a coupling portion 52, an insertion hole 53, and bevel teeth 54. The coupling portion 52 couples with the sliding member 41, the insertion hole 53 is penetrated by the rotary shaft 13, and the bevel teeth 54 are provided around the insertion hole 53. The first bevel gear 51 couples with the sliding member 41 and rotates and moves integrally with the sliding member 41. Thus, the first bevel gear 51 rotates about the rotational center axis CX integrally with the sliding member 41 and the rotary shaft 13. The first bevel gear 51 also moves along the rotary shaft 13 with the sliding member 41.

As shown in FIG. 6, the moving unit 30 includes the rotary moving unit 32 that meshes with the base member 11. Further, the moving unit 30 includes the retainer 33 that retains the rotary moving unit 32. The rotary moving unit 32 of the moving unit 30 rotates by the rotational power received from the transmission member 31. The rotary moving unit 32 of the moving unit 30 meshes with the base member 11. Thus, when the rotary moving unit 32 rotates, the moving unit 30 moves along the base member 11.

More specifically, the rotary moving unit 32 meshes with the transmission member 31 and the base member 11. For example, the rotary moving unit 32 includes a pinion gear 55 and a second bevel gear 56. The pinion gear 55 meshes with the base member 11, and the second bevel gear 56 meshes with the first bevel gear 51 of the transmission member 31. The rotational center axis CA of the pinion gear 55 intersects the rotational center axis CX of the rotary shaft 13 perpendicularly. The rotational center axis of the second bevel gear 56 is aligned with the rotational center axis CA of the pinion gear 55. Thus, the second bevel gear 56 rotates about a line that intersects the rotational center axis CX of the rotary shaft 13 perpendicularly. The second bevel gear 56 is fixed to the pinion gear 55. Thus, the pinion gear 55 and the second bevel gear 56 rotate integrally with each other.

The retainer 33 includes a body portion 61, a first supported portion 64, and at least one second supported portion 67. The body portion 61 retains the rotary moving unit 32, the first supported portion 64 is supported by the base member 11, and the second supported portion 67 is supported by the rotary shaft 13. In the embodiment, the retainer 33 includes two second supported portions 67.

The body portion 61 of the retainer 33 includes a concave portion 62 and a spindle 63. The concave portion 62 receives the pinion gear 55, and the spindle 63 projects from the bottom surface 62*a* of the concave portion 62. The spindle 63 is provided in the central portion of the concave portion 62. The center axis of the spindle 63 is aligned with the rotational center axis CA of the pinion gear 55. A fastening portion 78 (described later) provided on the retainer 33 is coupled with the door leaf 3. Thus, the door leaf 3 is opened or closed when the moving unit 30 moves.

Figure 8:
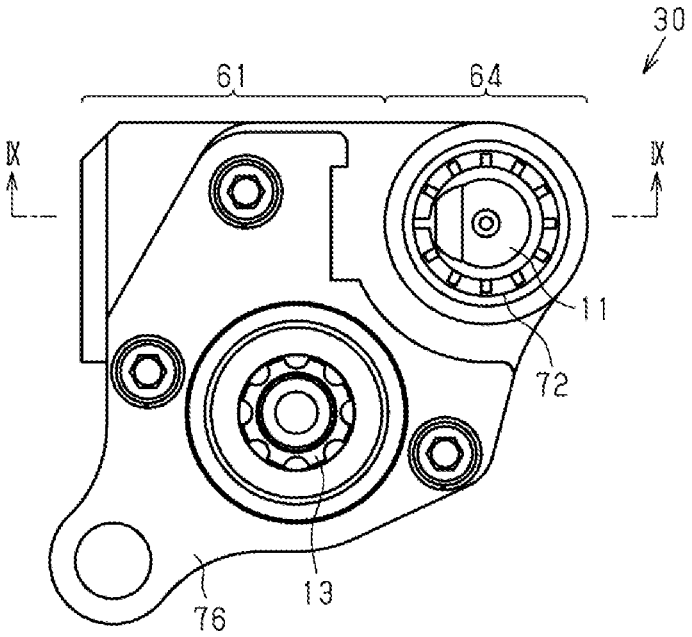
FIG. 8 is a side view of the moving unit.
Figure 9:
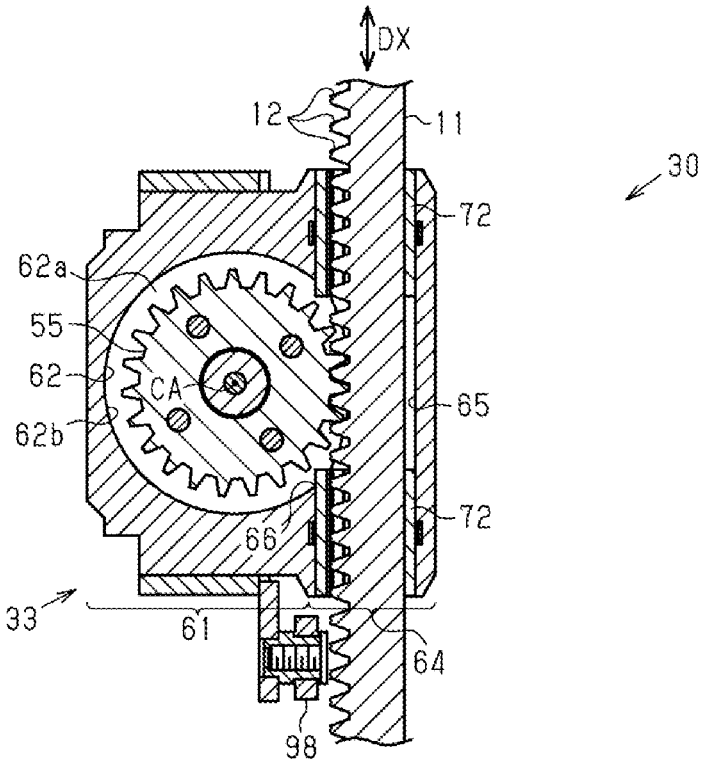
FIG. 9 is a sectional view along a line IX-IX of FIG. 8.

As shown in FIGS. 8 and 9, the first supported portion 64 is provided laterally to the concave portion 62 in the body portion 61. The first supported portion 64 is integrated with the body portion 61. The first supported portion 64 has an insertion hole 65 penetrated by the base member 11. The insertion hole 65 extends to intersect an inner peripheral surface 62*b* of the concave portion 62. The insertion hole 65 is connected to the concave portion 62 at a location where the insertion hole 65 intersects the concave portion 62. The location where the insertion hole 65 is connected to the concave portion 62 is herein referred to as "an intersection opening 66." In the intersection opening 66, the pinion gear 55 and the base member 11 mesh with each other. The base member 11 penetrates the first supported portion 64 via a pair of sliding members 72 having a tubular shape. The sliding members 72 are fixed on the insertion hole 65 of the first supported portion 64.

The pair of second supported portions 67 project from the body portion 61 along the rotational center axis CA of the pinion gear 55. The pair of second supported portions 67 are located such that the concave portion 62 is interposed therebetween in the direction along the rotational center axis CX of the rotary shaft 13, and the pair of second supported portions 67 are also spaced from each other in the extension direction DX of the base member 11 (see FIG. 5). Each of the pair of second supported portions 67 has an insertion hole 68 penetrated by the rotary shaft 13. One of the second supported portions 67 is supported by the rotary shaft 13 via the sliding member 41 of the transmission member 31. The other of the second supported portions 67 is supported by the rotary shaft 13 via another sliding member 74. The other sliding member 74 has the same structure as the sliding member 41 of the transmission member 31 (see FIG. 6). The sliding members 41, 74 penetrate the insertion holes 68, 68 of the second supported portions 67 via bearings 45, 75 (see FIG. 10). The sliding members 41, 74 and the bearings 45, 75 are mounted to the second supported portions 67 via brackets 76, 76 and stoppers 77, 77. The brackets 76, 76 each have a fastening portion 78 fastened to the door leaf 3.

Figure 10:
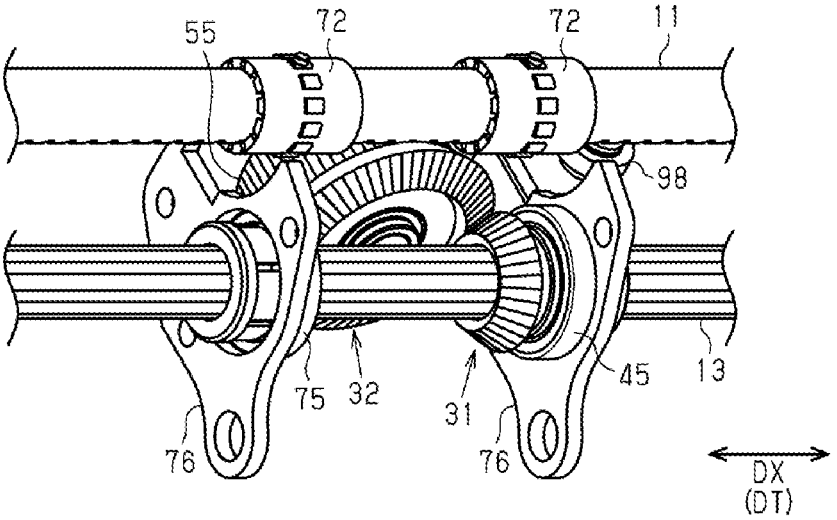
FIG. 10 explains an operation of the moving unit.
Figure 11:
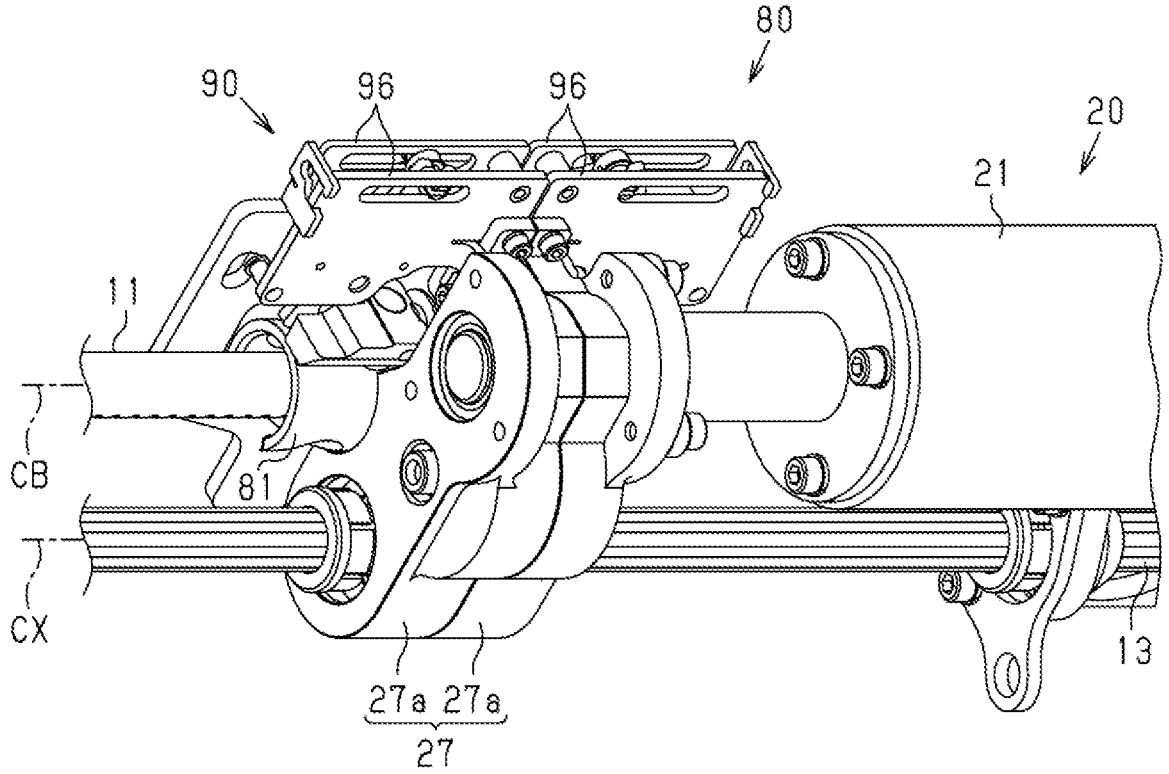
FIG. 11 is an enlarged perspective view of a locking device.

An operation of the door driving device 10 will now be described with reference to FIG. 10.

When the rotary shaft 13 rotates, the transmission member 31 rotates with rotation of the rotary shaft 13. The rotation of the transmission member 31 causes the rotary moving unit 32 to rotate. The rotation of the rotary moving unit 32 causes the moving unit 30 to move in the opening width direction DT by meshing between the pinion gear 55 of the rotary moving unit 32 and the base member 11. The movement of the moving unit 30 causes the transmission member 31 to move along the rotary shaft 13 with the moving unit 30. Therefore, the rotational power is continuously transmitted from the rotary shaft 13 to the rotary moving unit 32 via the transmission member 31. Thus, in the door driving device 10, the moving unit 30 can be moved by the different structure than in a slide mechanism in which a nut is driven on rotation of a screw. In summary, the moving unit 30 is driven by converting the rotational power into a rotational power of the pinion gear 55 meshing with the base member 11. The rotational power of the rotary shaft 13, which is used to drive the moving unit 30, is transmitted to the rotary moving unit 32 via the transmission member 31. Thus, the moving unit 30 does not include a drive source such as a motor 21, and therefore, the moving unit 30 can have a smaller size than a moving unit that includes a drive source.

The locking device 80 provided on the door driving device 10 will now be described with reference to FIGS. 11 to 20.

The locking device 80 holds the door fully closed. The locking device 80 is positioned such that when the door leaf 3 of the door of the vehicle 1 reaches the door closing position, the locking device 80 can be coupled with a contact portion 3A that moves together with the door leaf 3. The locking device 80 prohibits the door leaf 3 from moving when the door leaf 3 reaches the door closing position. More specifically, when the door leaf 3 moves in the closing direction DTC and reaches the door closing position, the locking device 80 is coupled with the contact portion 3A (see FIG. 16) and prohibits the door leaf 3 from moving in the opening direction DTA.

The locking device 80 includes a rotating unit 81. The rotating unit 81 is supported by a supporting member (not shown) so as to be rotatable in the locking direction DL and the unlocking direction DU. The locking direction DL extends along the circumference around the rotational center axis CB. The unlocking direction DU is opposite to the locking direction DL.

The rotating unit 81 rotates about the rotational center axis CB that is parallel to the opening width direction DT of the door. The rotating unit 81 includes a cam (hereinafter referred to as "the first cam 82") that permits or prohibits the movement of the door leaf 3 in the opening width direction DT in accordance with the rotational position of the rotating unit 81. The first cam 82 can be coupled with the contact portion 3A.

Figure 16:
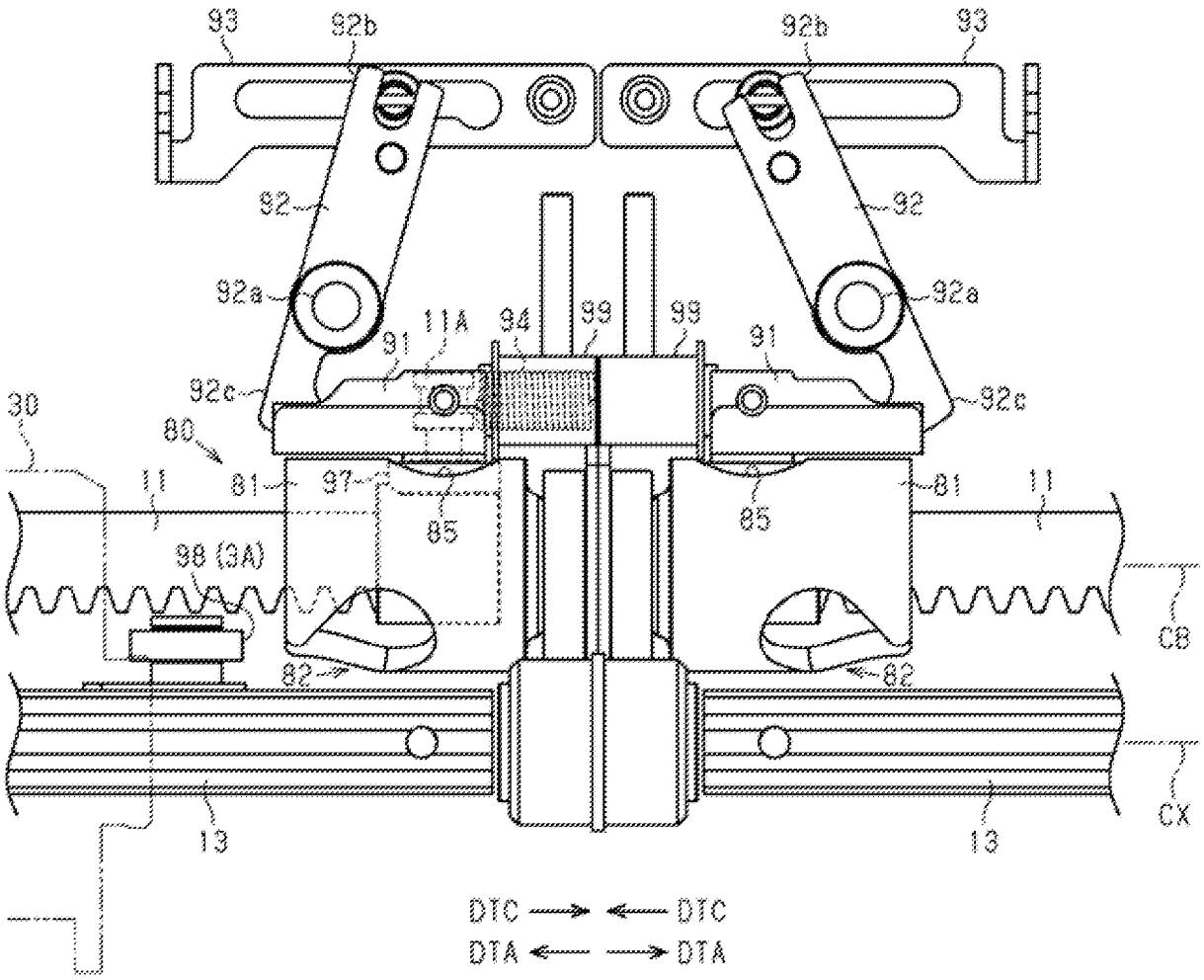
FIG. 16 is a partially transparent view of a locking device.

For example, the contact portion 3A described above is provided on the moving unit 30 so as to move together with the moving unit 30 (see FIG. 16). The contact portion 3A is configured as a roller (hereinafter referred to as "the moving unit roller 98") to be coupled with the locking device 80 (see FIGS. 5 and 16). The moving unit roller 98 is disposed at a distal end of the moving unit 30 in the closing direction DTC of the door leaf 3. More specifically, the moving unit roller 98 is provided on the moving unit 30 such that when the door leaf 3 moves in the closing direction DTC and reaches the door closing position, the moving unit roller 98 (the contact portion 3A) can enter the first cam 82 of the rotating unit 81.

Further, the rotating unit 81 includes a rotation prohibiting portion 81A. The rotation prohibiting portion 81A prohibits the rotation of the rotating unit 81 at such a position (the locking position) as to prohibit the movement of the door leaf 3 when the door leaf 3 has reached the door closing position (the fully closed position). The rotation prohibiting portion 81A is configured as a rotation restraining portion 87 of a second cam 85 provided in the rotating unit 81. The rotation prohibiting portion 81A is configured to contact with a locking roller 97 (described later) provided on the base member 11, thereby to prohibit rotation of the rotating unit 81.

Further, the locking device 80 restrains the base member 11 at a predetermined position. More specifically, when the door leaf 3 is at a position other than the door closing position, the locking device 80 fixes the base member 11 at a reference position such that it does not move in the opening width direction DT, and when the door leaf 3 reaches the door closing position, the locking device 80 releases the base member 11. Since the base member 11 is released when the door leaf 3 reaches the door closing position, when a pair of door leaves 3 at the fully closed position press each other to prohibit movement thereof, the force transmitted from the drive device 20 to the moving unit 30 diverts to the base member 11, such that the load imparted to the drive device 20 when the door is fully closed (the load imparted to the gears in the drive device 20) can be reduced. As will be described later, the means for releasing the base member 11 is configured in accordance with the relationship between the second cam 85 and the locking roller 97 provided on the base member 11.

The base member 11 has a roller (hereinafter referred to as "the locking roller 97") configured to be coupled with the rotating unit 81 (see FIG. 16). The locking roller 97 is positioned such that it can be coupled with the rotating unit 81. The base member 11 can move between the reference position and a shift lock position in the extension direction DX of the base member 11 (i.e., the opening width direction DT of the moving unit 30). The shift lock position is located in the opening direction DTA (the direction in which the door leaf 3 opens) from the reference position. When the door leaf 3 is in a position other than the door closing position, the base member 11 is coupled with the rotating unit 81 and fixed at the reference position. When the door leaf 3 is in the door closing position, the base member 11 is released from coupling with the rotating unit 81 and thus permitted to move from the reference position to the shift lock position. The base member 11 is biased at a projection 11A projecting from the base member 11 by a biasing spring 94 in the opening direction DTA (the direction from the reference position toward the shift lock position) (see FIG. 16). The biasing spring 94 is housed in a housing tube 99 such that the biasing spring 94 is contracted and expanded in a direction aligned with the moving direction of the base member 11.

Further, the locking device 80 preferably has the following two means for moving the door leaf 3 in the opening direction DTA when the door leaf 3 is in the door closing position. The first means moves the base member 11 in a predetermined direction by a force transmitted to the base member 11 via the moving unit 30 when the door leaf 3 stopped at the fully closed position starts moving in the opening direction DTA (described later). The second means moves the base member 11 in a predetermined direction (the direction from the shift lock position back to the reference position) by a force resisting the biasing spring 94 (described later). When the drive device 20 operates on the power source and the moving unit 30 moves by the power of the drive device 20, at least the first means operates. When the power source stops and the drive device 20 does not operate, the second means operates. In the embodiment, the first means and the second means are combined. As will be described later, movement of the base member 11 permits unlocking.

Figure 12:
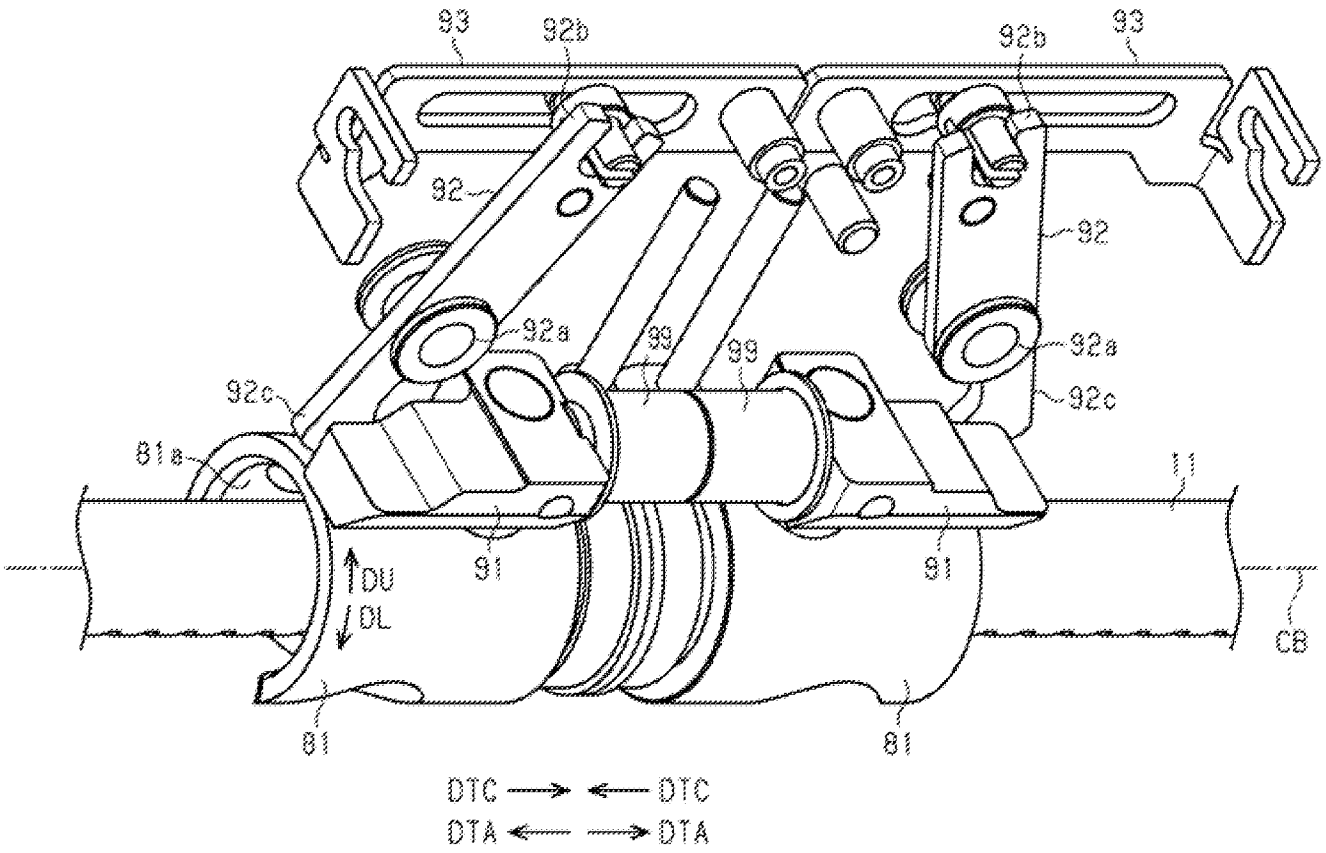
FIG. 12 is a perspective view of the locking device with a casing and a cover removed therefrom.
Figure 13:
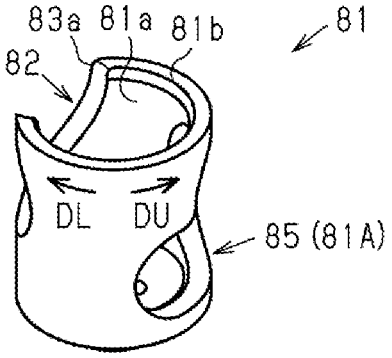
FIG. 13 is a perspective view of a rotating unit.
Figure 14:
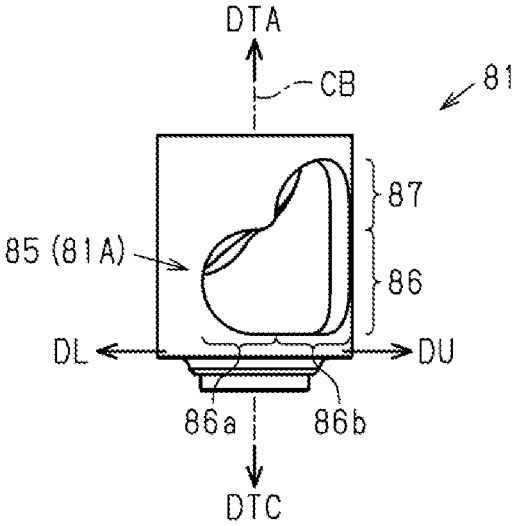
FIG. 14 is a side view of the rotating unit as viewed from a given point of view.
Figure 15:
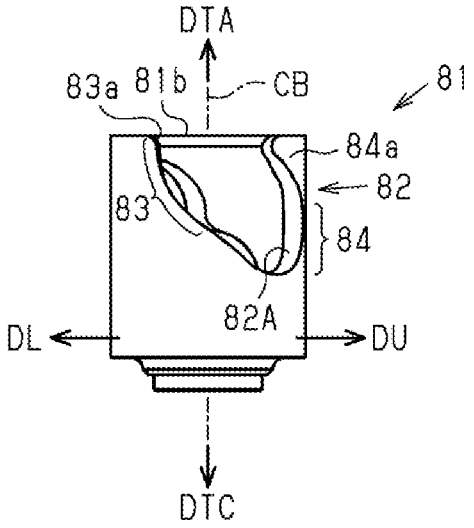
FIG. 15 is a side view of the rotating unit as viewed from a point of view opposite to that in FIG. 14.
Figure 17:
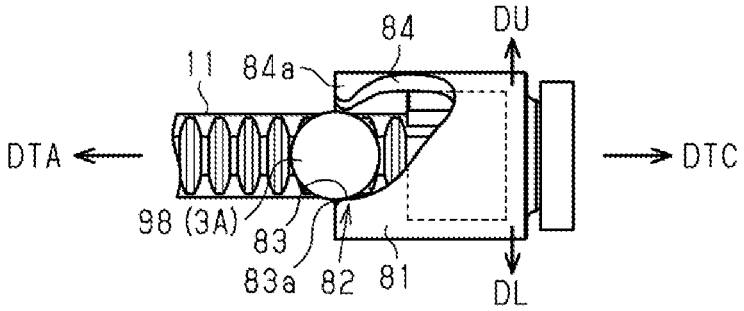
FIG. 17 shows an arrangement of a moving unit roller with respect to the rotating unit as viewed immediately before the door leaf reaches a door closing position.
Figure 18:
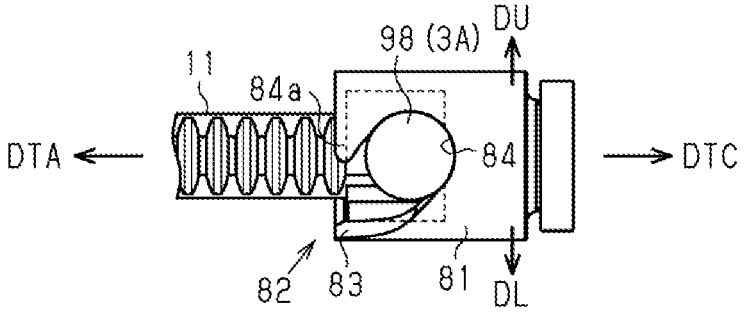
FIG. 18 shows an arrangement of the moving unit roller with respect to the rotating unit as viewed when the door leaf reaches the door closing position.
Figure 19:
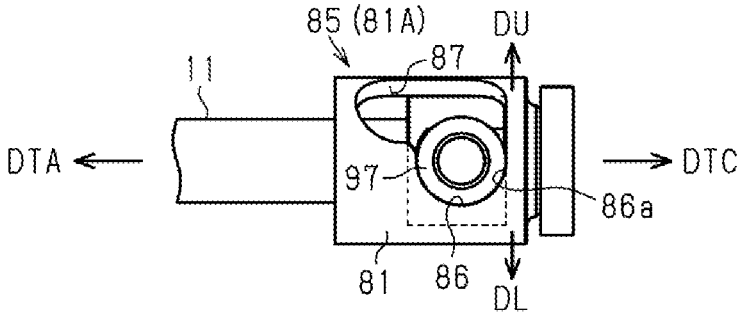
FIG. 19 shows an arrangement of a locking roller with respect to the rotating unit as viewed immediately before the door leaf reaches the door closing position.
Figure 20:
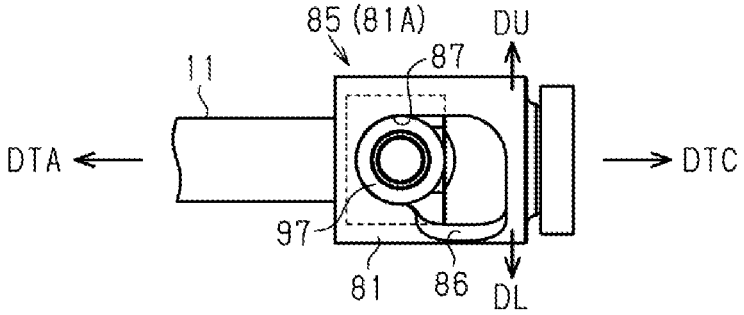
FIG. 20 shows an arrangement of the locking roller with respect to the rotating unit as viewed when the door leaf reaches the door closing position.

One example of the rotating unit 81 will now be described with reference to FIGS. 12 to 20. FIG. 12 is a perspective view of the locking device 80 with the casing 27 and the cover 96 removed therefrom. FIG. 13 is a perspective view of the rotating unit 81. FIG. 14 is a side view of the rotating unit 81 as viewed from a given point of view. FIG. 15 is a side view of the rotating unit 81 as viewed from a point of view opposite to that in FIG. 14. FIG. 16 is a partially transparent view of a locking device 80. FIGS. 17 and 19 show the rotating unit 81 in an unlocking position. FIG. 19 shows the opposite side to the side shown in FIG. 17. FIGS. 18 and 20 show the rotating unit 81 in a locking position. FIG. 20 shows the opposite side to the side shown in FIG. 18.

The rotating unit 81 has an insertion hole 81*a* penetrated by the base member 11. The rotating unit 81 rotates about the rotational center axis CB aligned with the center axis of the insertion hole 81*a*. The rotating unit 81 reciprocates between the locking position (see FIG. 18) and the unlocking position (see FIG. 17) by rotation. When the rotating unit 81 is in the locking position, the door leaf 3 is prohibited from moving. When the rotating unit 81 is in the unlocking position, the door leaf 3 is permitted to move. The rotating unit 81 rotates in the direction from the unlocking position toward the locking position (hereinafter referred to as "the locking direction DL") and reaches the locking position. Conversely, the rotating unit 81 rotates from the locking position in the direction opposite to the locking direction DL (hereinafter referred to as "the unlocking direction DU") and reaches the unlocking position.

The first cam 82 is configured to couple with the moving unit roller 98.

The first cam 82 has a cam surface 82*a* that contacts with the contact portion 3A. The cam surface 82A is configured such that the rotating unit 81 advances in the direction in which the locking roller 97 enters, while turning about the rotational center axis CB. More specifically, the first cam 82 is configured as a cutout penetrating from the outer circumferential surface of the rotating unit 81 to the insertion hole 81*a* and extending from the opening end 81*b* of the rotating unit 81. The cam surface 82A is configured as an end surface of the cutout.

More specifically, the first cam 82 includes an entrance portion 83 and a restraining portion 84.

The entrance portion 83 permits the moving unit roller 98 when the rotating unit 81 is in the unlocking position (see FIG. 17). The entrance portion 83 extends in the closing direction DTC from the opening end 81*b* of the rotating unit 81 on the opening direction DTA side so as to extend along the rotational center axis CB of the rotating unit 81, drawing toward the unlocking direction DU. When the rotating unit 81 is in the unlocking position, the opening portion 83*a* of the entrance portion 83 is at the same position as the moving unit roller 98 in the rotation direction of the rotating unit 81 (see FIG. 17). Therefore, when the moving unit roller 98 (the contact portion 3A) moves in the closing direction DTC together with the moving unit 30, the moving unit roller 98 enters the entrance portion 83. In the rotating unit 81, a portion of the entrance portion 83 in the unlocking direction DU side is referred to as a barrier portion 84*a*.

When the rotating unit 81 is in the locking position, the restraining portion 84 restrains the moving unit roller 98 (the contact portion 3A). The restraining portion 84 is an extension portion of the entrance portion 83. The barrier portion 84*a* is present on the opening direction DTA side of the restraining portion 84 (see FIG. 18). Thus, when the moving unit roller 98 enters the restraining portion 84, the moving unit roller 98 is prohibited from moving in the opening direction DTA. Therefore, unless the rotating unit 81 rotates, the moving unit roller 98 is held restrained, such that the moving unit 30 is prohibited from moving in the opening direction DTA.

Next, a description is given of the second cam 85.

The second cam 85 is configured to couple with the locking roller 97. For example, the second cam 85 is configured as a through-hole penetrating from the outer circumferential surface of the rotating unit 81 to the insertion hole 81*a*. The second cam 85 is positioned on the opposite side to the first cam 82 with respect to the rotational center axis CB of the rotating unit 81.

More specifically, the second cam 85 includes a rotation permitting portion 86 and a rotation restraining portion 87 (see FIG. 14). The rotation permitting portion 86 is configured such that the rotating unit 81 is permitted to rotate when the locking roller 97 is positioned in the rotation permitting portion 86. More specifically, the rotation permitting portion 86 includes a restraining end portion 86*a* and a guide groove 86*b* that extends from the restraining end portion 86*a* along the circumference about the rotational center axis CB of the rotating unit 81. When the rotating unit 81 is in the unlocking position, the restraining end portion 86*a* contacts with the locking roller 97 (see FIG. 19).

The rotation restraining portion 87 is configured such that the rotating unit 81 is prohibited from rotating (that is, the rotating unit 81 does not rotate) when the locking roller 97 is positioned in the rotation restraining portion 87. The rotation restraining portion 87 extends from the guide groove 86*b* of the rotation permitting portion 86 along the rotational center axis CB of the rotating unit 81. The width of the rotation restraining portion 87 in the rotation direction of the rotating unit 81 is equal to or slightly larger than the diameter of the locking roller 97. Therefore, when the rotating unit 81 rotates in the locking direction DL and the locking roller 97 enters the rotation restraining portion 87, the rotating unit 81 is prohibited from rotating (see FIG. 20).

When the locking roller 97 is positioned in the rotation permitting portion 86, the rotating unit 81 rotates in the unlocking direction DU and stops at the position where the restraining end portion 86*a* of the rotation permitting portion 86 contacts with the locking roller 97 (the unlocking position) (see FIG. 19), thereby prohibiting the base member 11 from moving in the opening direction DTA. That is, when the rotating unit 81 is in the unlocking position, the base member 11 is fixed at the reference position so as not to be movable. At this time, the opening portion 83*a* of the entrance portion 83 of the first cam 82 is positioned such that the moving unit roller 98 can enter the entrance portion 83 (see FIG. 17). On the other hand, when the rotating unit 81 rotates in the locking direction DL to reach the locking position and the locking roller 97 is positioned in the guide groove 86*b* of the rotation permitting portion 86, the locking roller 97 is permitted to rotate in the opening direction DTA, and the base member 11 is permitted to move in the opening direction DTA. When the base member 11 moves in the opening direction DTA to the shift lock position, the locking roller 97 enters the rotation restraining portion 87 to prohibit the rotating unit 81 from rotating. Since the rotating unit 81 is prohibited from rotating, the rotating unit is fixed at the locking position, and the coupling between the rotating unit 81 and the moving unit roller 98 (the contact portion 3A) is maintained. In this way, the door leaf 3 is locked at the door closing position.

An unlocking device 90 provided on the door driving device 10 will now be described with reference to FIG. 16. The unlocking device 90 releases the door leaf 3 prohibited from moving. The door leaf 3 prohibited from moving is released by a first means of the rotary shaft 13 rotating in a negative direction (described later) or by a second means of the unlocking device 90. The unlocking device 90 is used to open the door leaf 3 for emergency escape, door opening operation for access (in maintenance work or ride), or door unlocking operation performed when the rotary shaft 13 cannot be rotated due to malfunction of the motor 21.

The unlocking device 90 moves the base member 11 in the closing direction DTC. More specifically, the unlocking device 90 moves the base member 11 from the shift lock position to the reference position by an operation (either manual or electrical). More specifically, the unlocking device 90 includes a pressing member 91, a lever 92, and a guide member 93. The pressing member 91 presses the base member 11, the lever 92 applies a force to the pressing member 91, and the guide member 93 guides a power portion 92*b* of the lever 92. The lever 92 is supported by a cover 96. The lever 92 includes a fulcrum portion 92*a* that is interposed between the power portion 92*b* and an application portion 92*c*. The lever 92 rotates about the fulcrum portion 92*a*. The application portion 92*c* rotatably couples with the pressing member 91. A force is applied to the power portion 92*b* via a transmission member such as a cable. When a force is applied to the power portion 92*b* in accordance with an operation, the base member 11 is moved by the operation of the lever 92. When the base member 11 is moved from the shift lock position to the reference position by the operation of the unlocking device 90, the locking roller 97 comes out of the rotation restraining portion 87 to permit the rotating unit 81 to rotate, making it possible that the moving unit roller 98 (the contact portion 3A) withdraw from the first cam 82, and thus the door leaf 3 becomes movable.

Next, a description is given of an operation of the locking device 80.

First, an operation of the locking device 80 performed when the door is being fully closed will now be described with reference to FIGS. 17 to 20.

FIG. 17 shows an arrangement of the moving unit roller 98 with respect to the rotating unit 81 as viewed immediately before the door leaf 3 reaches the door closing position. When the door leaf 3 is in a position immediately before reaching the door closing position, the rotating unit 81 is in the unlocking position. FIG. 18 shows an arrangement of the moving unit roller 98 with respect to the rotating unit 81 as viewed when the door leaf 3 reaches the door closing position. When the door leaf 3 has reached the door closing position, the rotating unit 81 is in the locking position. FIG. 19 shows an arrangement of the locking roller 97 with respect to the rotating unit 81 as viewed immediately before the door leaf 3 reaches the door closing position. When the door leaf 3 is in a position immediately before reaching the door closing position, the rotating unit 81 is in the unlocking position. FIG. 20 shows an arrangement of the locking roller 97 with respect to the rotating unit 81 as viewed when the door leaf 3 reaches the door closing position. When the door leaf 3 has reached the door closing position, the rotating unit 81 is in the locking position.

When the door leaf 3 is fully opened and a command to close the door leaf 3 causes the motor 21 to drive the rotary shaft 13, the rotary shaft 13 rotates in a positive direction (the rotation direction for moving the moving unit 30 in the closing direction DTC). The rotation of the rotary shaft 13 is transmitted to the rotary moving unit 32 via the transmission member 31. Thus, the pinion gear 55 rotates and the moving unit 30 moves in the closing direction DTC.

As shown in FIG. 17, when the door leaf 3 comes to a position immediately before reaching the door closing position, the moving unit roller 98 enters the entrance portion 83 of the first cam 82 of the rotating unit 81. Thus, the rotating unit 81 rotates in the locking direction DL. In this way, the rotating unit 81 rotates from the unlocking position to the locking position. When the rotating unit 81 is in the locking position, the locking roller 97 is permitted to move from the rotation permitting portion 86 to the rotation restraining portion 87 of the second cam 85.

When the door leaf 3 is in the door closing position, as shown in FIG. 18, the moving unit roller 98 of the moving unit 30 is positioned in the restraining portion 84 of the first cam 82. In addition, when the door leaf 3 is in the door closing position, the pair of door leaves 3 pressing each other prohibit the moving unit 30 from moving, as described above. When the moving unit 30 is prohibited from moving, the rotational power of the rotary shaft 13 is transmitted to the base member 11 via the transmission member 31 and the rotary moving unit 32 of the moving unit 30. At this time, the force applied to the base member 11 acts on the base member 11 in the opening direction DTA. Therefore, the base member 11 receives the force for moving the base member 11 in the opening direction DTA (the force of the first means). Since the base member 11 is biased by the biasing spring 94 in the opening direction DTA, the base member 11 receives the force for moving the base member 11 in the opening direction DTA even when the power source stops and the drive device 20 does not operate (the force of the second means). On the other hand, as described above, the locking roller 97 is permitted to move from the rotation permitting portion 86 to the rotation restraining portion 87 of the second cam 85, and therefore, the base member 11 moves in the opening direction DTA. When the base member 11 has moved to the shift lock position, the locking roller 97 is positioned in the rotation restraining portion 87 (see FIG. 20). Thus, the rotating unit 81 is prohibited from rotating because of engagement between the locking roller 97 and the rotation restraining portion 87. When the rotating unit 81 is prohibited from rotating, the moving unit roller 98 of the moving unit 30 is prohibited from moving in the opening direction DTA by the barrier portion 84*a*. More specifically, when a force is applied to the moving unit roller 98 in the opening direction DTA, the moving unit roller 98 contacts with the barrier portion 84*a*, and therefore, the rotating unit 81 receives a force for rotating in the unlocking direction DU. However, as described above, the rotating unit 81 is prohibited from rotating, and thus the rotating unit 81 does not rotate in the unlocking direction DU. Therefore, the moving unit roller 98 cannot move from the restraining portion 84 to the entrance portion 83. In this way, the moving unit 30 is prohibited from moving upon receiving an external force in the opening direction DTA on the moving unit 30 or the door leaf 3.

When the base member 11 is in the shift lock position, the pressing member 91 moves together with the base member 11 and the locking roller 97 into position. A sensor (not shown) is provided to sense the movement of the pressing member 91 that moves together with the locking roller 97, and this sensor outputs a signal to the drive device 20 when the pressing member 91 moves into position. The drive device 20 stops driving the rotary shaft 13 in response to this signal.

Next, an operation of the locking device 80 performed when the door leaf 3 is being opened will now be described.

When a command to cause the door that is fully closed to be opened is transmitted to the door driving unit 5, the motor 21 drives the rotary shaft 13 such that it rotates in the negative direction (the rotation direction for moving the moving unit 30 in the opening direction DTA). The rotation of the rotary shaft 13 is transmitted to the rotary moving unit 32 via the transmission member 31. Thus, the pinion gear 55 rotates. On the other hand, when the door leaf 3 is in the door closing position, the moving unit roller 98 of the moving unit 30 is restrained by the restraining portion 84 of the rotating unit 81. Therefore, at this moment, the moving unit 30 does not move, and the base member 11 moves toward the reference position with respect to the moving unit 30 and the rotating unit 81 (moves toward the closing direction DTC). Thus, the locking roller 97 moves in the closing direction DTC to enter the rotation permitting portion 86 of the rotating unit 81, and as a result, the rotating unit 81 is permitted to rotate. Since the moving unit roller 98 of the moving unit 30 receives the force acting in the opening direction DTA applied from the rotary shaft 13 rotating in the negative direction, the moving unit roller 98 presses the barrier portion 84*a* of the first cam 82 of the rotating unit 81, and therefore, the rotating unit 81 rotates in the unlocking direction DU. In this way, the rotating unit 81 rotates to the unlocking position, and the moving unit roller 98 comes out of the first cam 82. Thus, the door leaf 3 is unlocked.

Next, a description is given of an operation of the unlocking device 90.

When the door is fully closed, the base member 11 is biased in the opening direction DTA by the biasing spring 94 and is positioned in the shift lock position. The force of the biasing spring 94 is applied to the lever 92 via the pressing member 91. When a force resisting the biasing force is applied to the power portion 92*b* of the lever 92, the lever 92 rotates against the biasing force, and the base member 11 moves from the shift lock position toward the reference position (moves in the closing direction DTC). Thus, the locking roller 97 enters the rotation permitting portion 86 of the rotating unit 81, and as a result, the rotating unit 81 is permitted to rotate. In this state, when a force to open the door leaf 3 is applied to the door leaf 3, the moving unit roller 98 presses the barrier portion 84*a* of the first cam 82 of the rotating unit 81, and therefore, the rotating unit 81 rotates in the unlocking direction DU. The moving unit roller 98 moves in the opening direction DTA, and at the same time, the rotating unit 81 rotates to the unlocking position. In this way, the moving unit roller 98 comes out of the first cam 82. Thus, the moving unit 30 that is prohibited from moving is released (unlocked).

Advantageous effects of the embodiment will be hereinafter described.

(1) The locking device 80 includes the first cam 82 that is formed in the rotating unit 81 configured to rotate about the rotational center axis CB that is parallel to the opening width direction DT of the door, and the first cam 82 permits or prohibits the movement of the door leaf 3 in the opening width direction DT in accordance with the rotational position of the rotating unit 81. With this arrangement, the door leaf 3 can be locked easily.

(2) In the locking device 80, the first cam 82 has the cam surface 82A configured to contact with the contact portion 3A that moves together with the door leaf 3, and the cam surface 82A is configured such that the first cam 82 advances in the direction in which the contact portion 3A enters, while turning about the rotational center axis CB. With this arrangement, the rotating unit 81 including the first cam 82 can be rotated when the contact portion 3A that moves together with the door leaf 3 contacts with the cam surface 82A.

(3) The locking device 80 includes the rotation prohibiting portion 81A that prohibits the rotation of the rotating unit 81 at such a position as to prohibit the movement of the door leaf 3 when the door leaf 3 has reached the door closing position. With this arrangement, the door leaf 3 can be prohibited from moving.

(4) The door driving unit 5 includes the locking device 80 described above and the door driving device 10. When the first cam 82 is in the unlocking position where the door leaf 3 is permitted to move in the opening width direction DT, the door driving device 10 can drive the door leaf 3 in the opening width direction DT. With this arrangement, when the first cam 82 is in the unlocking position where the door leaf 3 is permitted to move in the opening width direction DT, the door leaf 3 can be driven in the opening width direction DT.

(5) The door driving device 10 includes the base member 11 and the rotary moving unit 32. The base member 11 extends in the opening width direction DT of the door, and the rotary moving unit 32 is in contact with the base member 11 and configured to rotate and move along the base member 11, thereby to move the door leaf 3 in the opening width direction DT. In this arrangement, the moving unit 30 does not include a drive source such as a motor, and therefore, the moving unit 30 can have a small size.

(6) When the door leaf 3 has reached the door closing position (the fully closed position), the base member 11 can move in the opening direction DTA of the door leaf 3 by the drive force of the motor 21 (the force transmitted to the base member 11 via the rotary shaft 13 and the moving unit 30). Since the base member 11 moves along the opening direction DTA of the door leaf 3 by the drive force of the motor 21 applied when the door leaf 3 has reached the door closing position (the fully closed position), the base member 11 contacts with the rotation prohibiting portion 81A (the rotation restraining portion 87 of the second cam 85), thereby to prohibit the rotating unit 81 from rotating. With this arrangement, when the door leaf 3 is positioned in the door closing position, the rotation of the rotating unit 81 can be prohibited by the movement of the base member 11. Therefore, the rotation of the rotating unit 81 can be prohibited with a simple structure.

(7) In the door driving unit 5, the second cam 85 as the rotation prohibiting portion 81A is positioned in the opposite side of the rotating unit 81 to the first cam 82 with respect to the rotational center axis CB. With this arrangement, the rotating unit 81 having the rotational center axis CB can be formed in a short dimension.

<Other Embodiments>

The above embodiment is not limited to the examples described above. The above embodiment may be modified as follows. For the variants described below, components substantially the same as those in the above embodiment are denoted by the same reference signs as those in the above embodiment.

In the above embodiment, the arrangement of the drive device 20 is not limited. Although it was described for the embodiment that the drive device 20 is not disposed in the moving unit 30 for downsizing the moving unit 30, it is also possible to provide the drive device 20 in the moving unit 30. That is, the drive device 20 moves together with the moving unit 30. In addition, it is also possible to provide the drive device 20 on an end portion of the rotary shaft 13 in the opening direction DTA.

The locking device 80 may be formed of a plurality of components. For example, the locking device 80 may be formed of a first component, a second component, and a link mechanism. The first component couples with the moving unit 30 to prohibit the moving unit 30 from moving, the second component fixes the base member 11 releasably, and the link mechanism interlocks the first component with the second component.

In the locking device 80, when the door leaf 3 reaches the door closing position, the rotating unit 81 releases the base member 11 and moves the base member 11, thereby to prohibit the rotating unit 81 from rotating. It is also possible that the means for prohibiting the rotating unit 81 from rotating is other than the engagement between the rotating unit 81 and the base member 11. For example, after rotation of the rotating unit 81, the rotating unit 81 may engage with a cam or a lever that rotates in accordance with the movement of the base member 11, thereby to prohibit the rotating unit 81 from rotating.

In the above embodiment, the sectional structure of the rotary shaft 13 is not limited to the example described above. The section of the rotary shaft 13 perpendicular to the rotational center axis CX may have any shape that the rotational power can be applied to the transmission member 31 by rotation of the rotary shaft 13. More specifically, the section of the rotary shaft 13 has a non-circular shape, such as a polygon, a shape with a projection, and a shape with a groove.

In the above embodiment, the rotational center axis of the transmission member 31 is parallel with the rotational center axis CX of the rotary shaft 13, but it may not be aligned with the rotational center axis CX. In the case where the rotational center of the transmission member 31 is not aligned with that of the rotary shaft 13, the transmission member 31 is supported by a shaft member extending in parallel with the rotary shaft 13. This shat member is provided on the retainer 33. The rotary shat 13 is provided with a gear, and the transmission member 31 is provided with a gear that meshes with the gear of the rotary shaft 13. In this arrangement, the external teeth of the rotary shaft 13 mesh with the external teeth of the transmission member 31, and therefore, the rotary shaft 13 and the transmission member 31 rotate in opposite directions. The operation of the door driving device 10 is substantially the same as that described for the embodiment.

The locking device 80 is applicable to unlimited areas. The locking device 80 can be applied to door driving units having a door leaf 3. For example, the locking device 80 can be applied to door driving units including a reversible screw and a nut, in addition to door driving units having the rack-and-pinion structure.

What is claimed is:

1. A locking device comprising:

a first cam formed in a rotating unit configured to rotate about a rotational center axis that is parallel to an opening width direction of a door, the first cam being configured to permit or prohibit movement of a door leaf in the opening width direction in accordance with a rotational position of the rotating unit; and a second cam formed in the rotating unit, the second cam being configured as a rotation prohibiting portion for prohibiting rotation of the rotating unit at such a position as to prohibit the movement of the door leaf when the door leaf has reached a door closing position.

2. The locking device according to claim 1, wherein the first cam has a cam surface configured to contact with a contact portion that moves together with the door leaf, and wherein the cam surface is configured such that the rotating unit rotates about the rotational center axis as the contact portion advances in a direction that the contact portion enters.

3. A door driving unit, comprising:

a locking device comprising a cam formed in a rotating unit configured to rotate about a rotational center axis that is parallel to an opening width direction of a door, the cam being configured to permit or prohibit movement of a door leaf in the opening width direction in accordance with a rotational position of the rotating unit; and a door driving device for driving the door leaf in the opening width direction when the cam is in such a position as to permit the movement of the door leaf in the opening width direction.

4. The door driving unit according to claim 3, wherein the door driving device includes:

a base member extending in the opening width direction of the door; and a rotary moving unit in contact with the base member, the rotary moving unit being configured to rotate and move along the base member, thereby to move the door leaf in the opening width direction.

5. The door driving unit according to claim 4, wherein the base member is capable of moving in an opening direction of the door leaf by a drive force of a motor when the door leaf has reached a door closing position, and wherein the base member moving in the opening direction of the door leaf contacts with a rotation prohibiting portion for prohibiting rotation of the rotating unit, thereby to prohibit the rotating unit from rotating.

6. The door driving unit according to claim 5, wherein the rotation prohibiting portion, formed as a second cam, is positioned in an opposite side of the rotating unit to the cam, formed as a first cam, with respect to the rotation center axis.

* * * * *